United States Patent [19]

Blösl

[11] Patent Number: 4,951,455

[45] Date of Patent: Aug. 28, 1990

[54] APPARATUS FOR DISSIPATING HEAT FROM HEAT PRODUCING ELEMENTS OF A TEXTILE MACHINE

[75] Inventor: Karl Blösl, Süssen, Fed. Rep. of Germany

[73] Assignee: Zinser Textilmaschinen GmbH, Fed. Rep. of Germany

[21] Appl. No.: 363,052

[22] Filed: Jun. 8, 1989

[30] Foreign Application Priority Data

Jun. 10, 1988 [DE] Fed. Rep. of Germany ..... 3819867

[51] Int. Cl.[5] ..... D01H 13/28

[52] U.S. Cl. ..... 57/308; 57/100

[58] Field of Search ..... 57/100, 304, 308

[56] References Cited

U.S. PATENT DOCUMENTS

| | | | |
|---|---|---|---|
| 2,924,062 | 2/1960 | Sutcliffe | 57/308 X |
| 3,086,348 | 4/1963 | Fowler et al. | 57/308 X |
| 3,378,998 | 4/1968 | Shackelford | 57/308 X |
| 4,679,389 | 7/1987 | Wolf | 57/308 X |
| 4,853,566 | 8/1989 | Dinkelmann et al. | 57/308 X |

FOREIGN PATENT DOCUMENTS

| | | | |
|---|---|---|---|
| 1254058 | 11/1967 | Fed. Rep. of Germany . | |
| 2086440 | 5/1982 | United Kingdom | 57/100 |

*Primary Examiner*—Joseph J. Hail, III

*Attorney, Agent, or Firm*—Shefte, Pinckney & Sawyer

[57] ABSTRACT

A heat dissipating arrangement for electric drive units and like heat producing elements enclosed in an end housing of a textile spinning or like machine, includes an intake opening and a discharge opening in the housing, and a fan to draw ambient air into the housing through the intake opening, through the housing in heat-exchange relation with the heat producing elements, and outwardly through the discharge opening. The discharge opening has a relatively narrow lateral extent transversely to a longitudinal central vertical plane through the machine and a longitudinal extent of a greater dimension aligned with the central vertical plane so that contact between the discharge heated air and supply bobbins suspended about the end housing is minimized.

10 Claims, 1 Drawing Sheet

APPARATUS FOR DISSIPATING HEAT FROM HEAT PRODUCING ELEMENTS OF A TEXTILE MACHINE

BACKGROUND OF THE INVENTION

The present invention relates to a means for dissipating heat from heat producing elements of a textile machine and, more particularly, to a means for dissipating heat from electric drive units and the like which are enclosed in an end frame housing or the like of a textile spinning or like machine.

Certain types of textile machines, such as ring spinning machines and twisting machines, typically include electric drive units which are mounted in a housing at one longitudinal end of the machine frame. The electric drive units tend to develop relatively considerable heat during their operation. To optimize the operation of these electric drive units, it is known to circulate air thereover to effect heat exchange between the electric drive units and the air and to discharge the heated air from the end frame housings, whereby the electric drive units are cooled.

In response to the design considerations that heated air tends to rise and that the air in the area of the textile machines generally tends to be relatively cooler toward the floor than toward the ceiling, the known devices for circulating cooling air past the electric drive units are typically constructed to intake air through the lower portion of the end frame housing and to discharge the air through the upper portion of the end frame housing.

Spinning and twisting machines typically include overhead conveyor assemblies which convey a supply of bobbins longitudinally along the machines. Due to the placement of these overhead conveyor assemblies, the supply bobbins are typically conveyed along a path which passes over the top of the end frame housing. As a result, the heated air discharge from the end frame housing tends to contact those supply bobbins suspended above the end frame housing, thereby causing undesirable drying of the yarn of the bobbins. When the yarn on the supply bobbins has been unduly dried, the unwinding of the yarn from the bobbin may be hindered due to the occurrence of yarn breaks which tend to occur with more frequency in overly dried yarn than normal yarn.

SUMMARY OF THE INVENTION

Accordingly, the present invention provides a means for dissipating heat from heat producing elements of a textile machine.

Briefly described, the present invention provides means for dissipating heat away from the heat producing elements of a textile spinning or like machine of the type having an elongate longitudinal extent generally centered about a vertical plane extending longitudinally through the machine and including a housing at one end of the machine for enclosing operational heat-producing elements of the machine. The dissipating means includes an air intake in the end housing, an air discharge opening in the end housing at the longitudinal plane, means for drawing ambient air into the housing through the intake opening, directing the ambient air through the end housing in heat-exchange relation with the heat-producing elements therein, and then exhausting the ambient air from the end housing outwardly. The discharge opening has a lateral extent transversely with respect to the longitudinal central plane and a longitudinal extent generally aligned with the longitudinal central plane, the longitudinal extent of the discharge opening being of a relatively greater dimension than the lateral extent of the discharge opening.

Preferably, the dimension of the longitudinal extent of the discharge opening is a multiple of the dimension of the lateral extent. Additionally, the discharge opening preferably includes a vertically extending air guide duct and a plurality of heat conducting vanes disposed below the air guide duct for conducting heat away from the heat producing elements for dissipating through the air guide duct.

According to one aspect of the present invention, the heat dissipating means includes a filter covering the air intake opening. Additionally, the air drawing, directing and exhausting means includes a fan adjacent the outlet opening.

According to another aspect of the present invention, the discharge opening includes an air guide duct at least partially surrounding the fan and extending from the fan to the discharge opening.

DETAILED DESCRIPTION OF THE PREFERRED EMBODIMENTS

Figure 1:
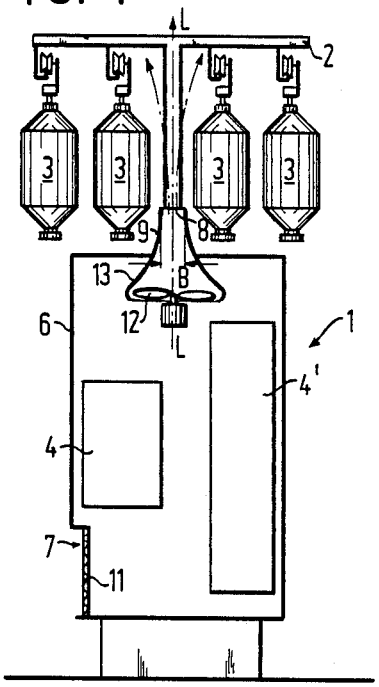
FIG. 1 is a schematic end elevational view of one preferred embodiment of the heat dissipating arrangement of the present invention.

In FIG. 1, one preferred embodiment of the heat dissipating arrangement of the present invention is illustrated in its installed position in a textile machine, such as a ring spinning machine or a twisting machine, generally indicated at 1. The textile machine 1 is of the type having a generally elongate longitudinal extent with the operating stations of the machine being disposed along each lateral side of a vertical plane L—L extending longitudinally centrally through the machine. A housing 6 is provided at one longitudinal end of the textile machine 1 for enclosed mounting of a plurality of electric or electronic drive units 4,4'. A supply bobbin conveying apparatus 2 includes a plurality of tracks supported above the textile machine, including the end housing 6, by a plurality of vertical supports 16 spaced longitudinally along the textile machine to extend in parallel relation to one another longitudinally along the textile machine. A plurality of supply bobbins 3 are suspended from the tracks by carriages which convey the supply bobbins 3 along the tracks of the supply bobbin conveying assembly 2 at a clearance above the end housing 6.

As will be understood, the drive units 4,4' tend to produce sufficient amounts of heat during normal operation of the textile machine that it is necessary or desirable to provide some means of cooling the drive units. For this purpose, the heat dissipating arrangement of the present invention is adapted to conduct heat away from drive units 4,4', of the end housing 6. Basically, the heat dissipating arrangement includes an intake opening 7 formed in the lower housing 6, a discharge opening 8 formed in the upper end of the housing 6, a fan 12 disposed between the intake opening 7 and the discharge opening 8 and an air guide duct 9 extending from the fan 12 to the discharge opening 8. The discharge opening 8 is located at the longitudinal central vertical plane L—L of the machine 1 and is of an elongated shape having a relatively narrow lateral extent B transversely with respect to the longitudinal central plane L—L and a longitudinal extent of relatively greater dimension generally aligned with the central vertical plane L—L.

A filter 11 is preferably disposed across the intake opening 7. The air guide duct 9 preferably includes air deflecting walls 13 which at least partially surround the fan 12 and extend therefrom in a tapering manner to an upper terminal end of the duct 9 which forms the discharge opening 8, thereby to confine the discharged emission of the air exiting through the discharge opening 8.

In operation, the fan 12 of the heat dissipating arrangement illustrated in FIG. 1 draws ambient air from the outside of the end housing 6 through the intake opening 7 at its lower end, upwardly through the interior of the housing 6, and outwardly through the air guide duct 9 and the discharge opening 8 at its upper end, the flow path being indicated schematically in FIG. 1 by the directional arrows. The ambient air is, of course, relatively cooler than the interior of the housing 6 due to the heat generated by the drive units 4,4', so that the air has a capacity for heat absorption. As the air moves through the housing 6, the air contacts and passes around the drive units 4,4' in heat-exchange relation therewith to effect heat transfer between the drive units 4,4' and the air. The heated air is then propelled by the fan 12 through the air guide duct 9 and discharged from the housing 6 out the discharge opening 8 in an upward direction indicated by the dot-dash lines and directional arrows in FIG. 1. As can be understood, the heated air is thus discharged generally in the longitudinal vertical central plane L—L in the area between the innermost rows of the suspended supply bobbins 3 disposed on each side of the central vertical plane L—L which area is occupied by the vertical supports 16, thereby avoiding undesirable contact of the air with the supply bobbins 3.

Figure 2:
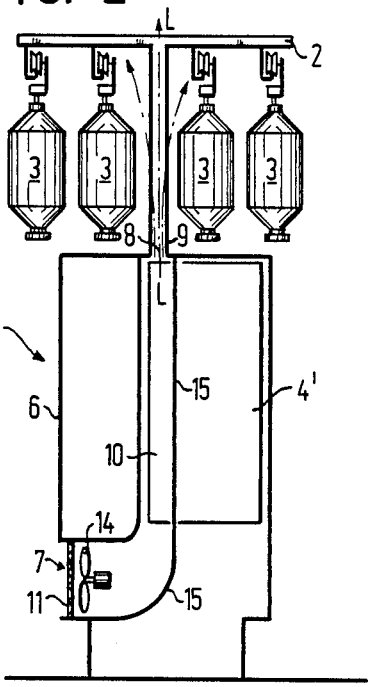
FIG. 2 is a schematic end elevational view of another preferred embodiment of the heat dissipating arrangement of the present invention.
Figure 3:
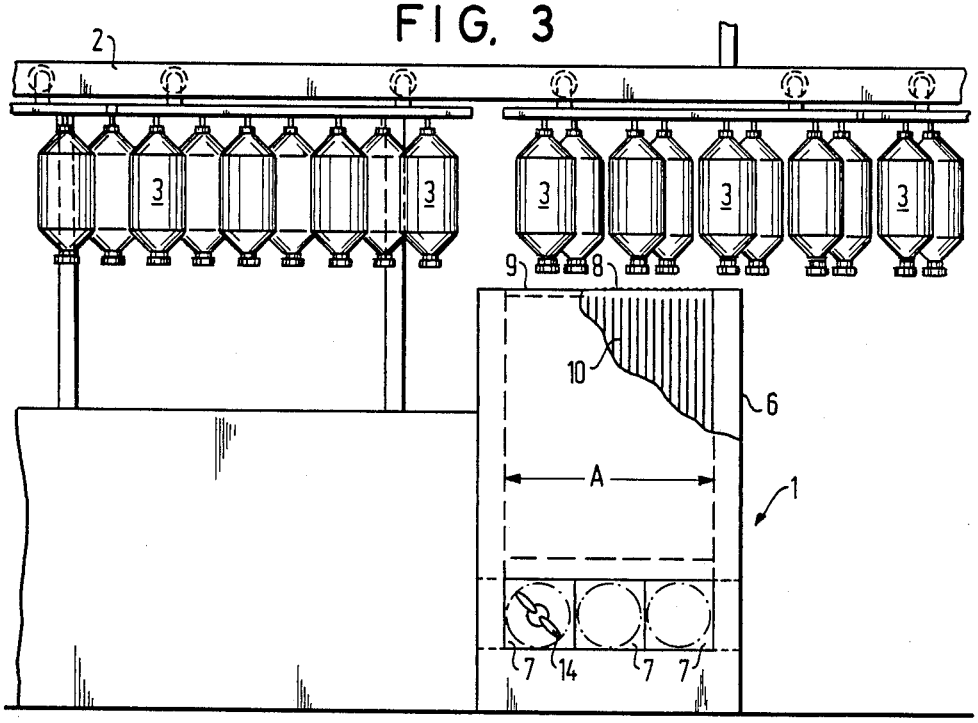
FIG. 3 is a schematic front elevational view of the heat dissipating arrangement shown in FIG. 2.

In FIGS. 2 and 3, another preferred embodiment of the heat dissipating arrangement of the present invention is illustrated and includes an intake opening 7 formed in the end housing 6 with a filter 11 disposed across the intake opening 7, a fan 14 located adjacent the intake opening 7 in a conduit 15 which extends from the intake opening 7 into and upwards through the end housing 6, and an air guide duct 9 at the upward end of the housing 6 forming an elongated discharge opening 8 from the housing 6 in alignment with the longitudinal vertical central plane L—L through the textile machine.

As in the embodiment of FIG. 1, the heat dissipating arrangement of FIGS. 2 and 3 serves to draw relatively cooler ambient air into the end housing 6, pass the air in heat exchange relation with the electric or electronic drive units 4' for cooling thereof, and converge the air for upwardly discharge through the discharge opening 8 in the plane L—L intermediate the inwardmost rows of supply bobbins 3 to avoid undesirable contact of the heated air therewith, as indicated by the broken line directional arrows of FIG. 2

As best shown in FIG. 3, the end housing 6 can be provided with an elongated intake opening 7 and a plurality of the fans 14 to effect optimum cooling of the electronic unit 4'. FIG. 3 further indicates the greater longitudinal extent A of the discharge opening 8 as contrasted to its transverse extent seen in FIG. 2. Preferably, the longitudinal extent A of the discharge opening 8 is a multiple of its transverse extent.

To increase the heat exchange effect of the ambient air flow through the conduit 15, a plurality of vertically extending, parallel cooling vanes or ribs 10 may be located within the conduit 15. The vanes 10 can be an integral part of the electrical drive unit 4' or a structural component of the end housing 6. The filter 11 disposed across the intake opening 7 prevents dirt, debris and textile by-products from passing through the intake opening 7. The filter 11 can be cleaned by selectively reversing the direction of rotation of the fan 14 to discharge air outwardly through the intake opening 7 to the outside of the end housing 6.

As can be understood, the heat dissipating arrangement of the present invention advantageously conducts heat away from the heat producing elements of the end housing of the textile machine and discharges the heated air into a region above the end housing in a manner to minimize the undesirable heating of the supply bobbins 3 suspended above the end housing. The supply bobbins are thus at reduced risk for being unduly heated so that more efficient unwinding of the yarn therefrom can be realized and the incidence of yarn breaks can be reduced.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a textile spinning or like machine of the type having an elongate longitudinal extent generally centered about a vertical plane extending longitudinally through the machine with textile supply packages situated above the machine at opposite sides of the longitudinal central plane and including a housing at one end of the machine for enclosing operational heat-producing elements of the machine, means for dissipating heat from the heat-producing elements, comprising:

an air intake opening in the end housing;

an air discharge opening in the end housing at the longitudinal central plane; and means for drawing ambient air into the end housing through the intake opening, directing the ambient air through the end housing in heat-exchange relation with the heat-producing elements therein, and then exhausting the ambient air from the end housing outwardly through the discharge opening, the discharge opening having a lateral extent transversely with respect to the longitudinal central plane and a longitudinal extent generally aligned with the longitudinal central plane, the longitudinal extent of the discharge opening being of a relatively greater dimension than the lateral extent of the discharge opening and the lateral extent of the discharge opening being of a smaller dimension than the transverse spacing between textile supply packages at opposite sides of the longitudinal central plane to avoid contact of the air exhausted through the air discharge opening with the textile supply packages.

2. In a textile machine, heat dissipating means according to claim 1 and characterized further in that the dimension of the longitudinal extent of the discharge opening is a multiple of the dimension of its lateral extent.

3. In a textile machine, heat dissipating means according to claim 1 and characterized further in that the discharge opening comprises a vertically extending air guide duct.

4. In a textile machine, heat dissipating means according to claim 3 and characterized further by a plurality of heat conducting vanes disposed below the air guide duct for conducting heat away from the heat producing elements for dissipation through the air guide duct.

5. In a textile machine, heat dissipating means according to claim 4 and characterized further in that the vanes extend adjacent the air guide duct.

6. In a textile machine, heat dissipating means according to claim 1 and characterized further by a filter covering the air intake opening.

7. In a textile machine, heat dissipating means according to claim 1 and characterized further in that the air drawing, directing and exhausting means comprises a fan located adjacent the outlet opening.

8. In a textile machine, heat dissipating means according to claim 7 and characterized further in that the discharge opening includes an air guide duct, at least partially surrounding the fan and extending therefrom to the discharge opening.

9. In a textile machine, heat dissipating means according to claim 1 and characterized further in that the air drawing, directing and exhausting means includes a fan located adjacent the intake opening.

10. In a textile machine, heat dissipating means according to claim 9 and characterized further by a plurality of heat conducting vanes for conducting heat away from the heat producing elements, and the air drawing, directing and exhausting means including a conduit extending from the fan to the vanes.

* * * * *